US010597922B2

(12) United States Patent
Chang

(10) Patent No.: US 10,597,922 B2
(45) Date of Patent: Mar. 24, 2020

(54) AUTOMATIC SLIDING DOOR

(71) Applicant: Liang-Yu Chang, New Taipei (TW)

(72) Inventor: Liang-Yu Chang, New Taipei (TW)

( * ) Notice: Subject to any disclaimer, the term of this patent is extended or adjusted under 35 U.S.C. 154(b) by 258 days.

(21) Appl. No.: 15/923,110

(22) Filed: Mar. 16, 2018

(65) Prior Publication Data

US 2018/0274277 A1 Sep. 27, 2018

(30) Foreign Application Priority Data

Mar. 27, 2017 (TW) ..... 106204245 U

(51) Int. Cl.

| | |
|---|---|
| ***E05F 1/00*** | (2006.01) |
| ***E05F 1/16*** | (2006.01) |
| ***E05D 15/06*** | (2006.01) |

(52) U.S. Cl.

CPC ..... *E05F 1/002* (2013.01); *E05D 15/063* (2013.01); *E05F 1/16* (2013.01); *E05D 15/0652* (2013.01); *E05F 1/00* (2013.01); *E05Y 2201/484* (2013.01); *E05Y 2201/492* (2013.01); *E05Y 2201/654* (2013.01); *E05Y 2600/45* (2013.01); *E05Y 2900/132* (2013.01)

(58) Field of Classification Search

CPC .... E05F 1/00; E05F 1/002; E05F 1/16; E05D 15/063; E05D 15/0652

USPC ..... 16/75, 76, 87 R, 96 R, 106, DIG. 7, 16/DIG. 20, DIG. 31

See application file for complete search history.

(56) References Cited

U.S. PATENT DOCUMENTS

| | | | | |
|---|---|---|---|---|
| 2,534,641 | A * | 12/1950 | Veigel | E05D 13/1215 16/94 R |
| 2,569,614 | A * | 10/1951 | Lewis | E05D 15/406 49/206 |
| 2,895,779 | A * | 7/1959 | Bender | E05F 1/16 312/139.2 |
| 2,905,463 | A * | 9/1959 | Borden | E05F 15/643 49/360 |
| 7,124,469 | B2 * | 10/2006 | Tsekhanovsky | E05F 1/16 16/79 |
| 7,258,153 | B2 * | 8/2007 | Chen | E05B 65/0085 16/76 |
| 8,595,898 | B2 * | 12/2013 | Smith | E05F 1/16 16/61 |

(Continued)

FOREIGN PATENT DOCUMENTS

| | | |
|---|---|---|
| CN | 201284594 Y | 8/2009 |
| KR | 101376097 B1 | 3/2014 |

(Continued)

OTHER PUBLICATIONS

English language Abstract of CN 201284594Y (Aug. 5, 2009).

(Continued)

*Primary Examiner* — Roberta S Delisle

(74) *Attorney, Agent, or Firm* — Hershkovitz & Associates, PLLC; Abe Hershkovitz

(57) ABSTRACT

An automatic sliding door has a rail, a reset component, a pulley set, and a door panel. The rail is mounted on a top surface of a door frame. The reset component is mounted on a first end of the rail and is fixed to the door frame. The pulley set is slidably mounted in the rail, and a bottom end of the pulley set extends out of the rail. The door panel is mounted at the bottom of the pulley set, and the pulley set drives the door panel to slide.

20 Claims, 10 Drawing Sheets

(56) References Cited

U.S. PATENT DOCUMENTS

| | | | | |
|---|---|---|---|---|
| 2013/0019432 | A1* | 1/2013 | Smith | E05F 1/16 16/49 |
| 2018/0274277 | A1* | 9/2018 | Chang | E05D 15/063 |

FOREIGN PATENT DOCUMENTS

| | | | |
|---|---|---|---|
| TW | 553300 | U | 9/2003 |
| TW | M306264 | U | 2/2007 |
| TW | 201307665 | A | 2/2013 |

OTHER PUBLICATIONS

English language Abstract of KR 101376097B1 (Mar. 19, 2014).
English language Abstract of TW M306264U (Feb. 11, 2007).
English language Abstract of TW 201307665A (Feb. 16, 2013).
English language Abstract of TW 553300U (Sep. 11, 2003).
Examination Report in related Chinese Patent Application No. 20180038595.8, dated Apr. 30, 2019.

* cited by examiner

AUTOMATIC SLIDING DOOR

BACKGROUND OF THE INVENTION

1. Field of the Invention

The present invention relates to a sliding door, and more particularly to an automatic sliding door which can close a door panel automatically.

2. Description of Related Art

A conventional sliding door has a rail and a door panel. The door panel is slidably mounted on the rail. Preferably, the door panel has multiple wheels mounted on a top surface or a bottom surface of the door panel. When users pull or push the door panel of the conventional sliding door, the door panel will slide along the rail to open or close the conventional sliding door.

However, the door panel of the conventional sliding door cannot be opened or closed automatically. If users forget to push or pull the door panel, the door panel would not restore back to the initial position. Therefore, an electrically automatic sliding door is invented, and the electrically automatic sliding door is driven by electric power. However, the electrically automatic sliding door is expensive for some users.

To overcome the shortcomings of the conventional sliding door, the present invention provides an automatic sliding door to mitigate or obviate the aforementioned problems.

SUMMARY OF THE INVENTION

The main objective of the present invention is to provide an automatic sliding door that would close a door panel automatically.

The automatic sliding door in accordance with the present invention comprises a rail, a reset component, a pulley set, and a door panel. The rail is mounted on a top surface of a door frame. The reset component is mounted on a first end of the rail and is fixed to the door frame. The pulley set is slidably mounted in the rail, and a bottom end of the pulley set extends out the rail. The door panel is mounted at the bottom of the pulley set, and the pulley set drives the door panel to slide.

Other objects, advantages, and novel features of the invention will become more apparent from the following detailed description when taken in conjunction with the accompanying drawings.

DETAILED DESCRIPTION OF PREFERRED EMBODIMENT

Figure 1:
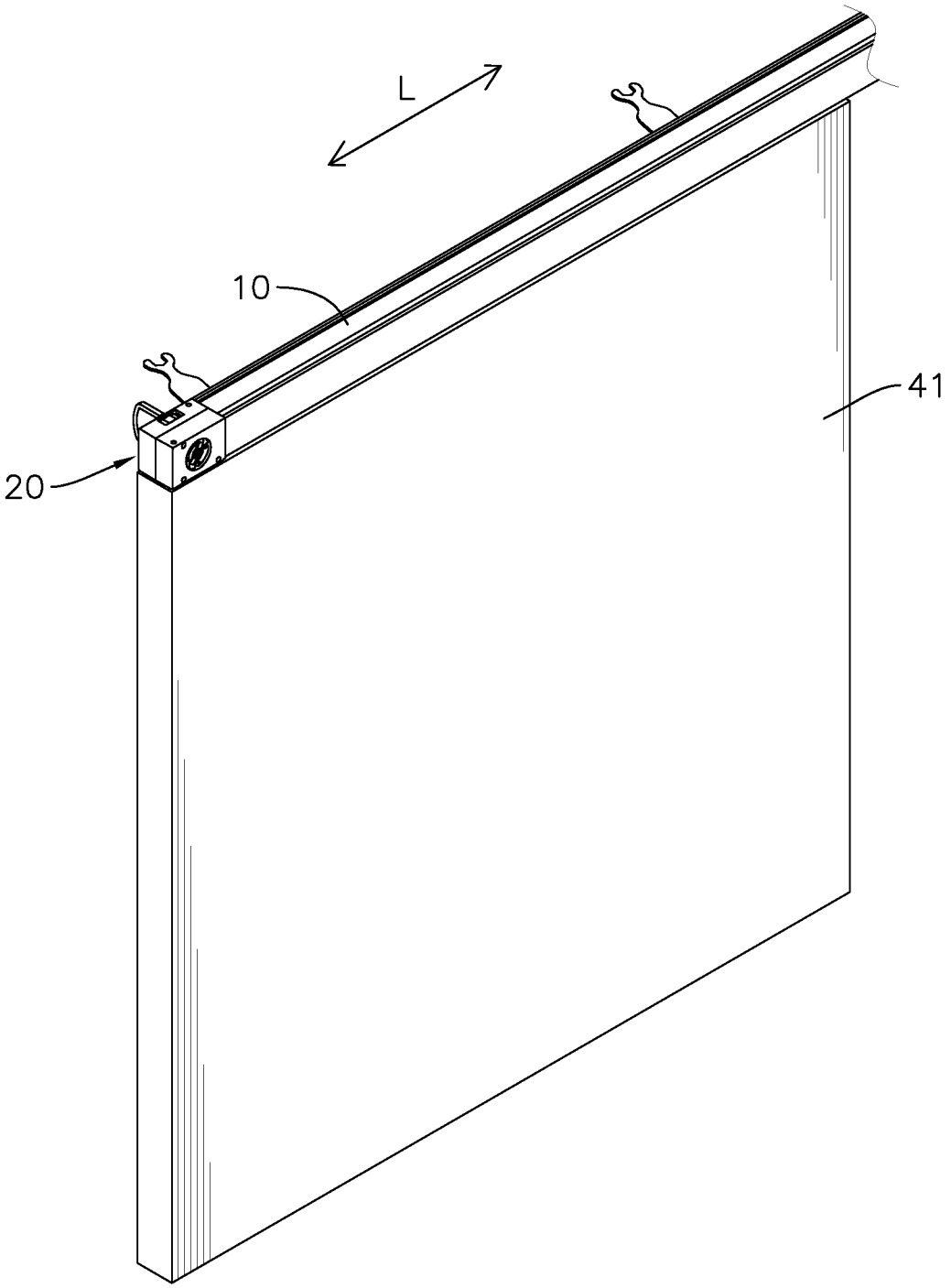
FIG. 1 is a perspective view of an automatic sliding door in accordance with the present invention.
Figure 2:
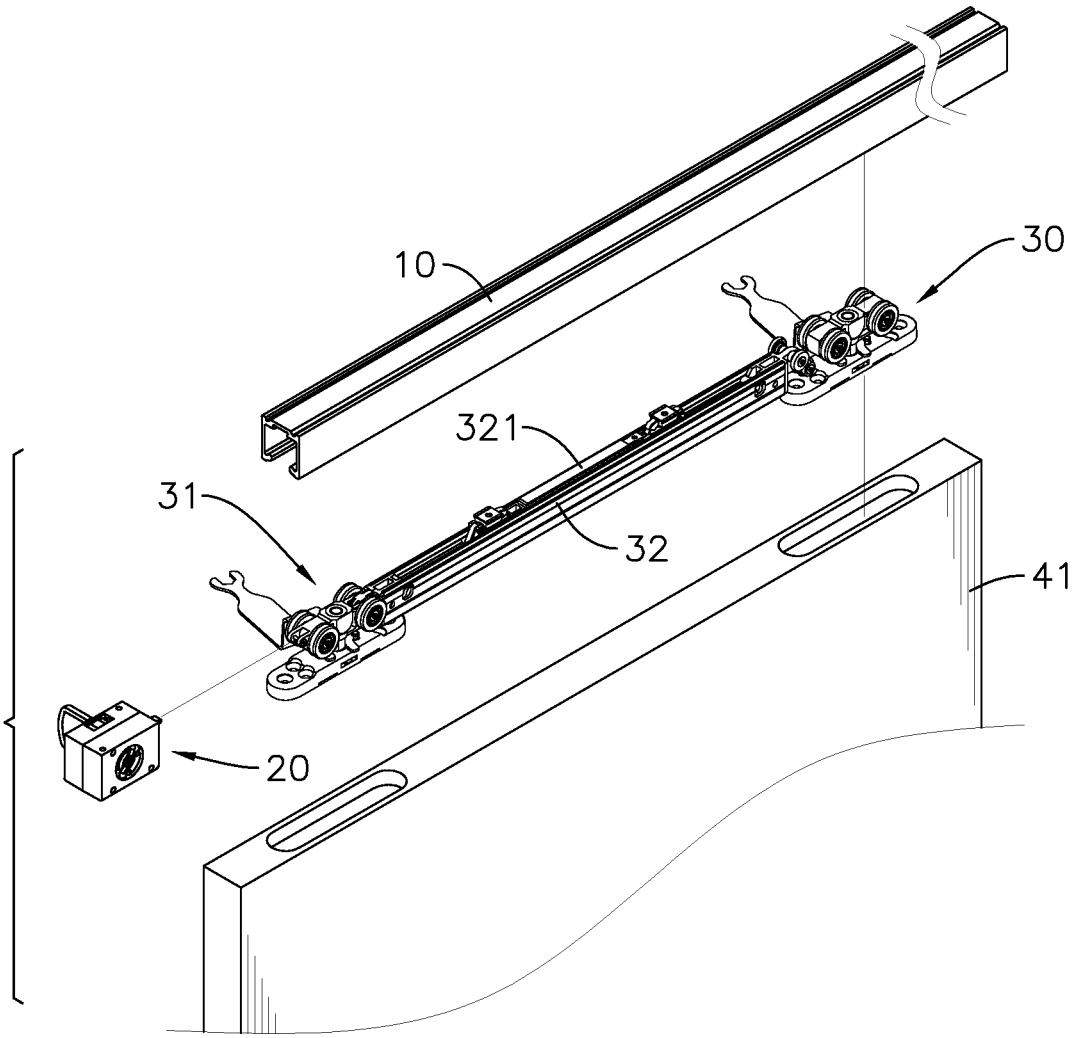
FIG. 2 is an enlarged exploded perspective view of the automatic sliding door in FIG. 1.

With reference to FIGS. 1 and 2, an automatic sliding door in accordance with the present invention comprises a rail 10, a reset component 20, a pulley set 30, and a door panel 41.

The rail 10 is mounted on a top surface of a door frame and has a first end and a second end. The reset component 20 is mounted on the top surface of the door frame and is disposed adjacent to the first end of the rail 10 in a direction L.

Figure 3:
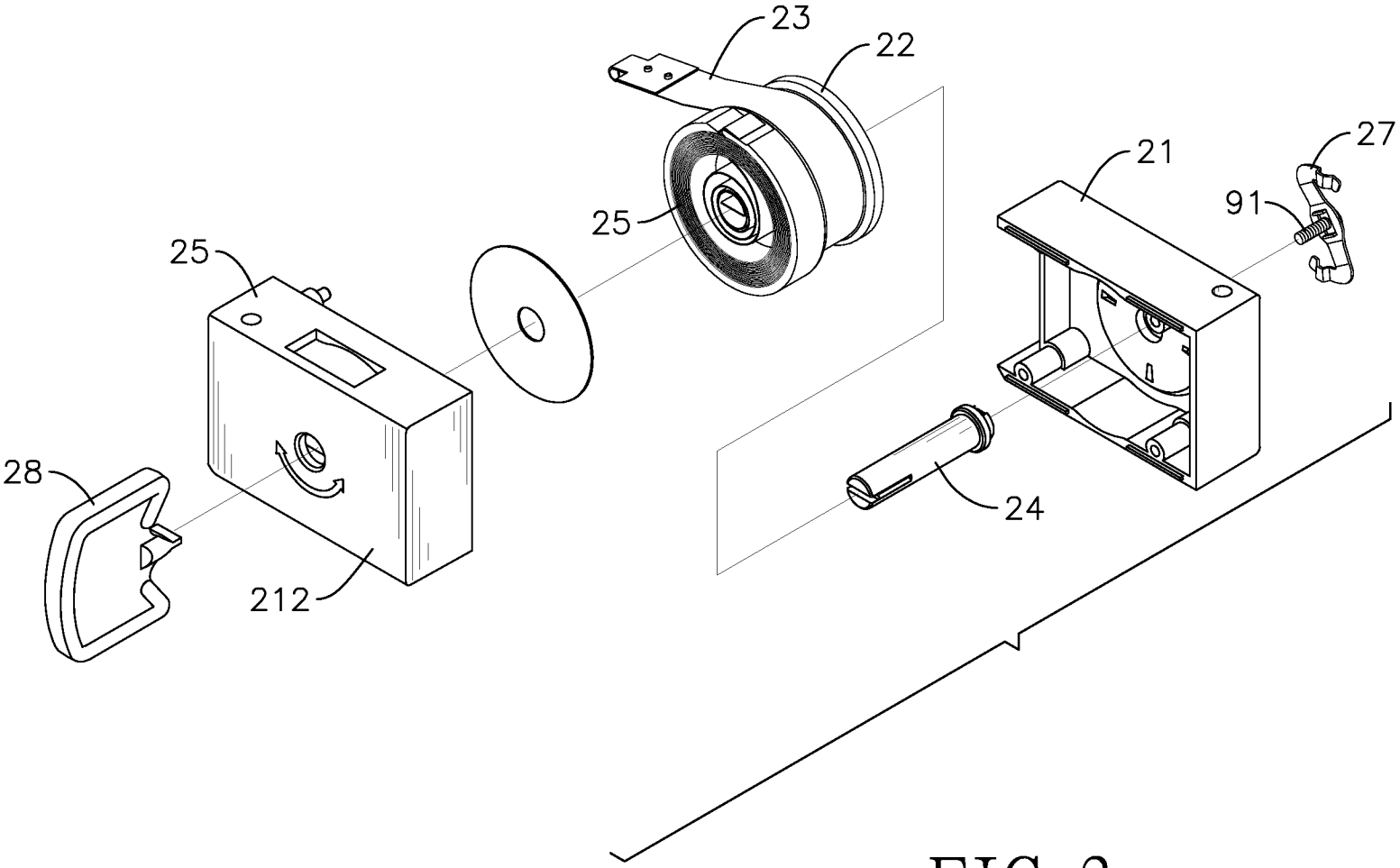
FIG. 3 is an enlarged exploded perspective view of the reset component of the automatic sliding door in FIG. 1.
Figure 4:
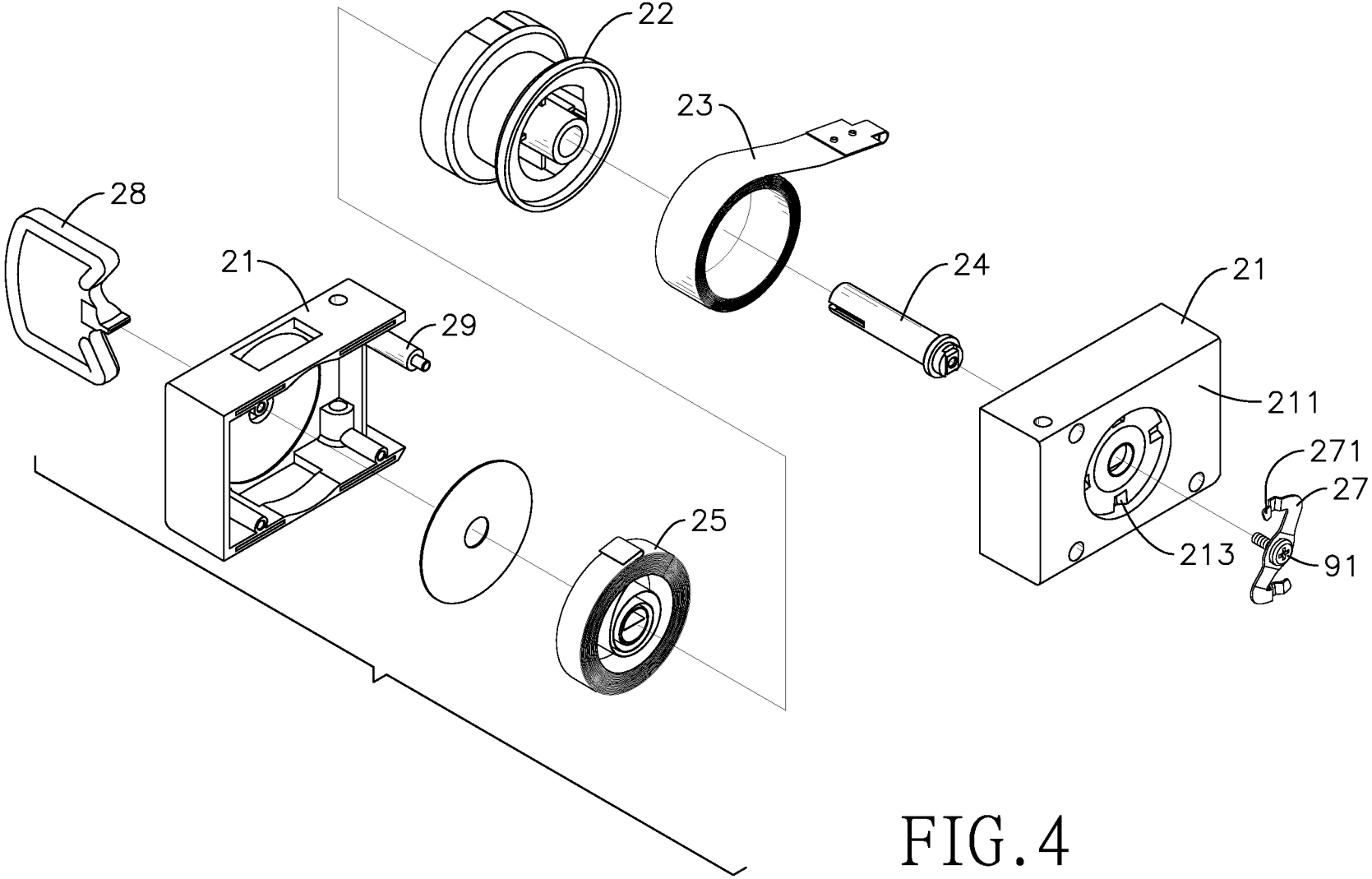
FIG. 4 is another enlarged exploded perspective view of the reset component of the automatic sliding door in FIG. 1.

With reference to FIGS. 3 and 4, the reset component 20 has a housing 21, a rod 22, a first elastic component 23, a fixed pillar 24, a second elastic component 25, a fixed clasp 27, a switch 28, and a guide wheel 29.

Figure 5:
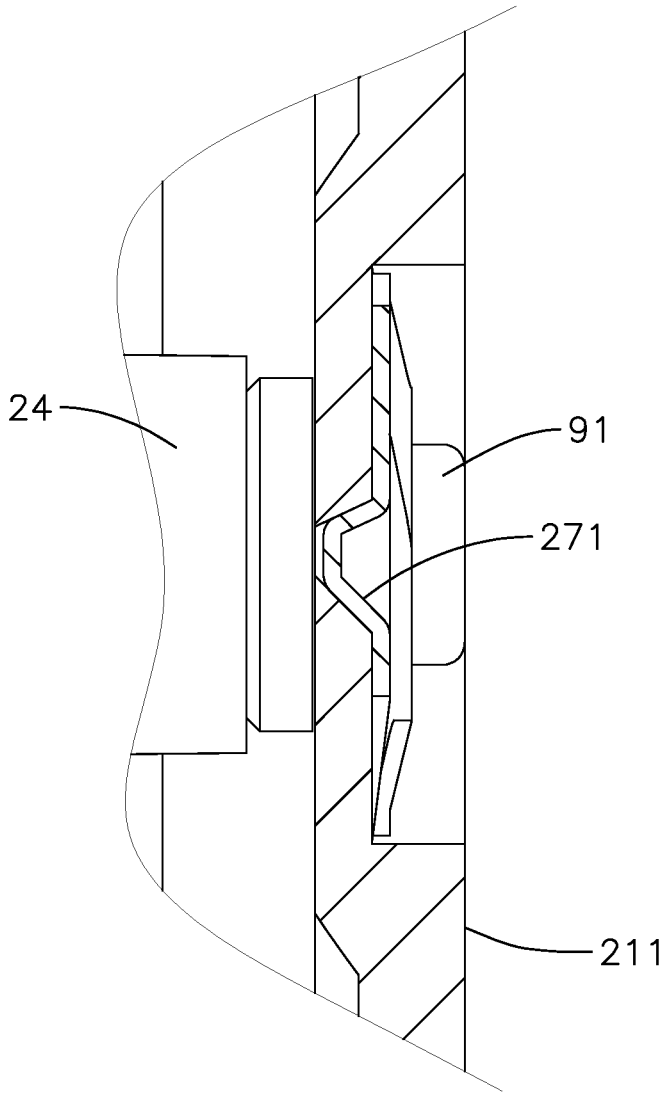
FIG. 5 is an enlarged side view in partial section of the automatic sliding door in FIG. 1.

With reference to FIGS. 3, 4 and 5, the housing 21 is mounted on the top surface of the door frame and is disposed adjacent to the first end of the rail 10 in the direction L. The housing 21 has a first side surface 211, a second side surface 212, and multiple mounting holes 213. The multiple mounting holes 213 are formed through the first side surface 211. Preferably, the housing 21 includes four mounting holes 213. The four mounting holes 213 are arranged in a circular shape. The rod 22 is rotatably mounted in the housing 21.

With reference to FIGS. 3 to 6, the first elastic component 23 is mounted in the housing 21 and is mounted around the rod 22. The first elastic component 23 has a first end and a second end. The first end of the first elastic component 23 is fixed to the rod 22. The second end of the first elastic component 23 extends out of the housing 21 along the direction L. Preferably, the first elastic component 23 is a torsion spring.

With reference to FIGS. 3 and 4, the fixed pillar 24 is rotatably mounted through the housing 21 and is mounted through the rod 22. The fixed pillar 24 has a first end and a second end. The first end of the fixed pillar 24 extends out of the first side surface 211 of the housing 21. The first end of the fixed pillar 24 is disposed at a center of the circle formed by the multiple mounting holes 213. The second end of the fixed pillar 24 extends out of the second side surface 212 of the housing 21.

The second elastic component 25 is mounted in the housing 21. Preferably, the second elastic component 25 is a torsion spring.

Figure 6:
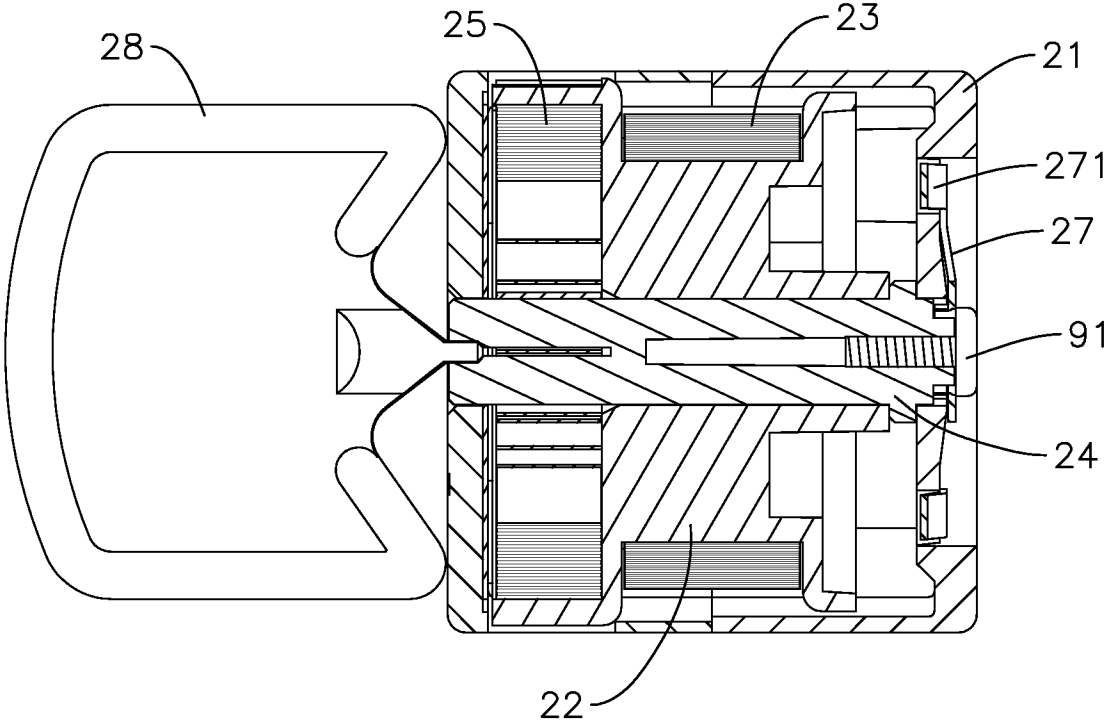
FIG. 6 is an enlarged side view in partial section of the reset component of the automatic sliding door in FIG. 1.
Figure 7:
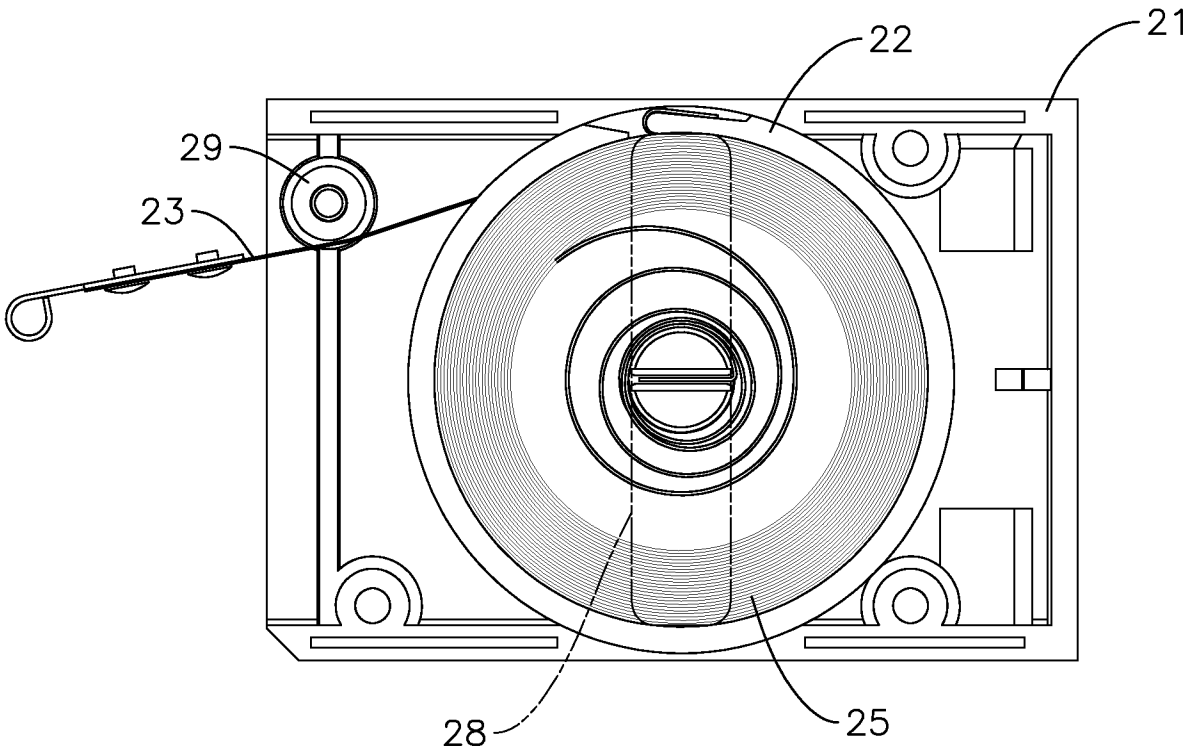
FIG. 7 is an enlarged side view of the reset component of the automatic sliding door in FIG. 1.
Figure 8:
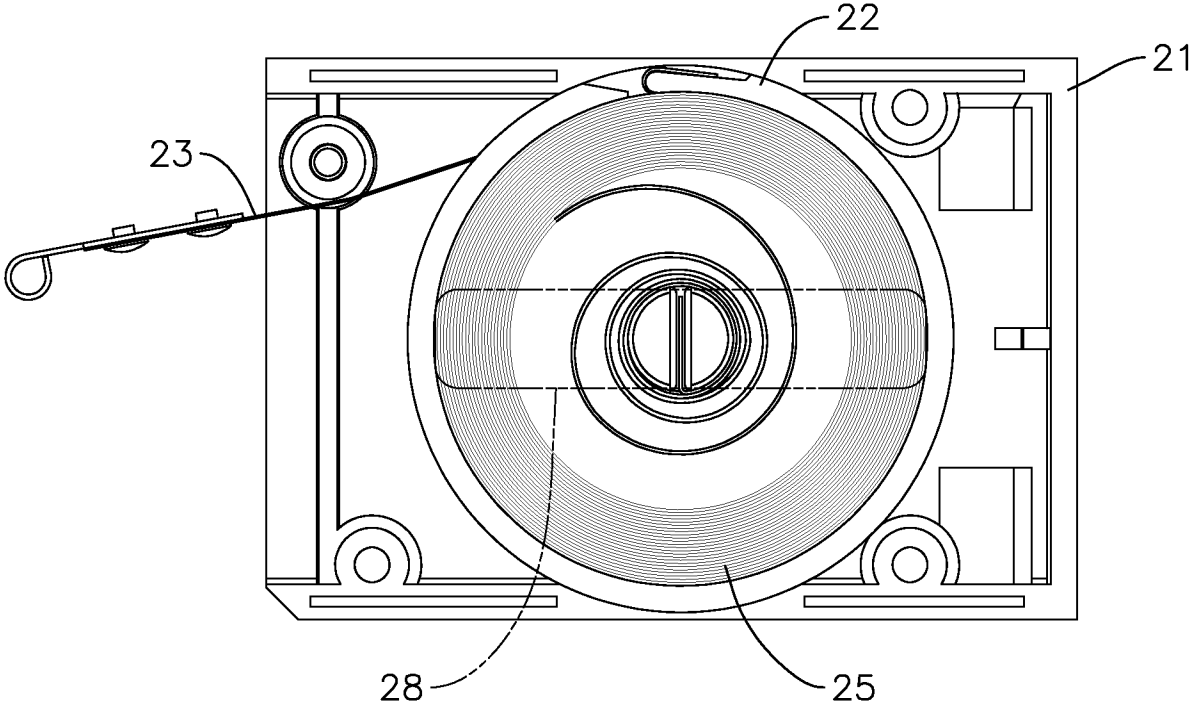
FIG. 8 is another enlarged side view of the reset component of the automatic sliding door in FIG. 1.

With reference to FIGS. 4, 6, and 7, the second elastic component 25 is mounted in the rod 22. The fixed pillar 24 is mounted through the second elastic component 25. The second elastic component 25 has a first end and a second end. The first end of the second elastic component 25 is fixed to the fixed pillar 24, so that the second elastic component 25 is driven to rotate by the fixed pillar 24. The second end of the second elastic component 25 is mounted on the rod 22, so that the rod 22 is driven to be rotated relative to the housing 21 by the second elastic component 25.

With reference to FIGS. 3, 4, and 5, the fixed clasp 27 is mounted on the first side surface 211 of the housing 21. Preferably, the fixed clasp 27 has two ends and two hooks 271. The two hooks 271 are respectively formed at the two ends of the fixed clasp 27. A screw 91 is mounted through a center of the fixed clasp 27 and is screwed with the first end of the fixed pillar 24, and the two hooks 271 are selectively engaged with two of the mounting holes 213. The fixed pillar 24 is secured and is free from rotating relative to the housing 21 by the engagement between the fixed clasp 27 and the first side surface 211.

With reference to FIGS. 3, 6, and 7, the switch 28 is mounted on the second surface 212 of the housing 21. The switch 28 is connected with the second end of the fixed pillar 24 and may drive the fixed pillar 24 to rotate.

Figure 9:
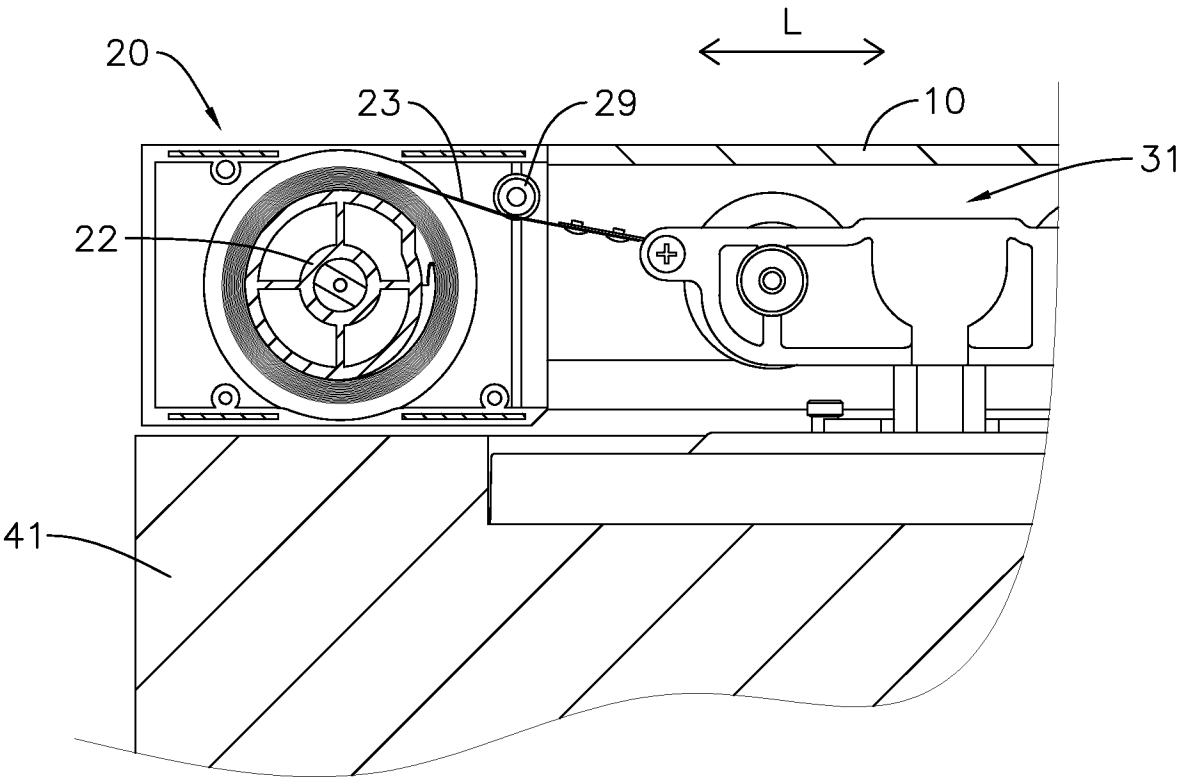
FIG. 9 is an enlarged operational side view in partial section of the automatic sliding door in FIG. 1.

With reference to FIGS. 3, 7 and 9, the guide wheel 29 is rotatably mounted in the housing 21, and the guide wheel 29 abuts the second end of the first elastic component 23.

Figure 10:
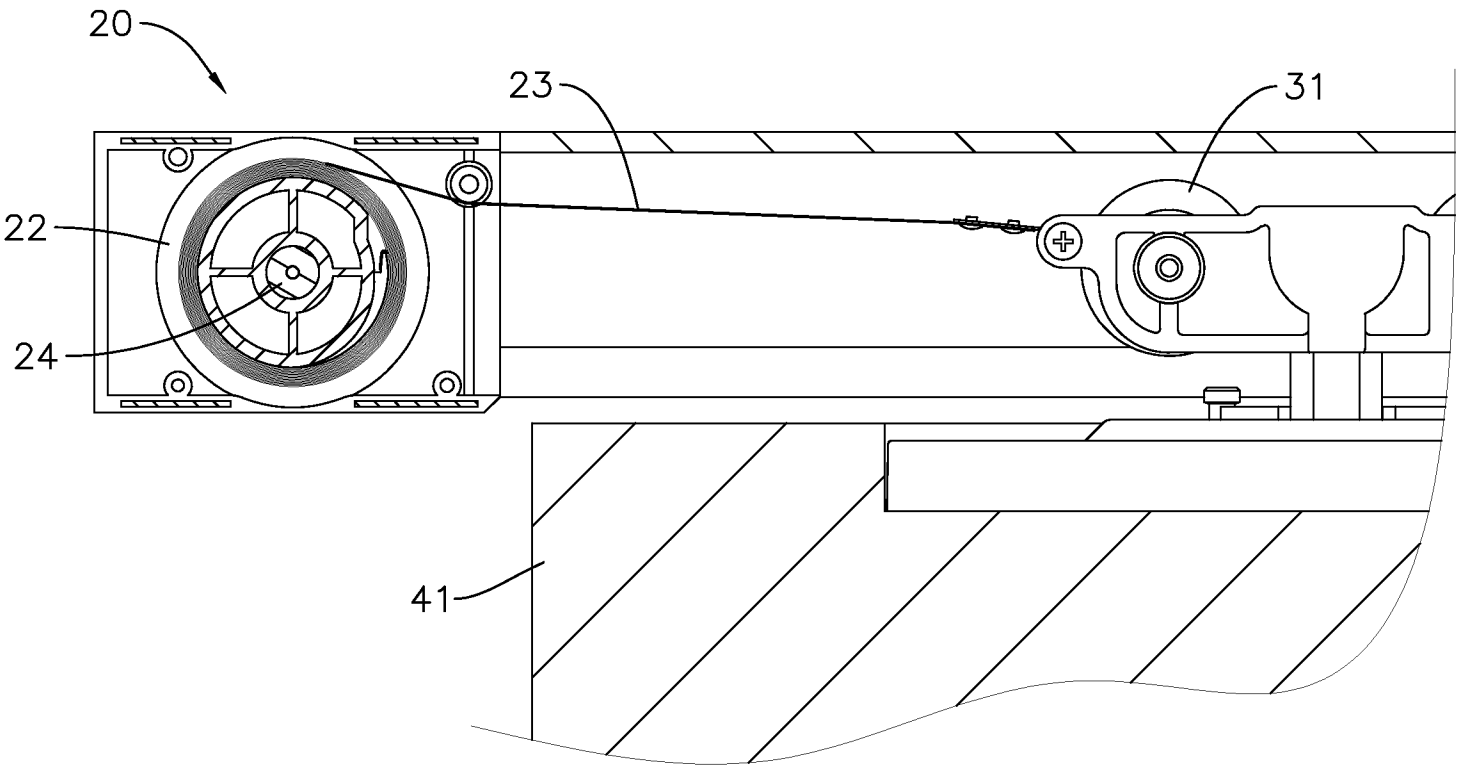
FIG. 10 is another enlarged operational side view in partial section of the automatic sliding door in FIG. 1.

With reference to FIGS. 2, 9, and 10, the pulley set 30 is mounted in the rail 10 in the direction L. A bottom of the pulley set 30 extends out of the rail 10. The pulley set 30 has a first end and a second end. The first end of the pulley set 30 is connected with the second end of the first elastic component 23. The first elastic component 23 would continually pull the pulley set 30 toward the reset component 20 in the direction L.

With reference to FIG. 2, the pulley set 30 further has at least one pulley 31 and a connector 32. Preferably, the pulley set 30 includes two pulleys 31, and the two pulleys 31 are respectively mounted at two ends of the connector 32.

The connector 32 further has a cushion 321, and the cushion 321 is mounted in the connector 32. The cushion 321 has two ends respectively connected with the two pulleys 31. Preferably, the cushion 321 is a pressure rod.

With reference to FIGS. 1 and 2, the door panel 41 is mounted at the bottom of the pulley set 30. The pulley set 30 may drive the door panel 41 to slide in the direction L. The two pulleys 31 are mounted on a top surface of the door panel 41 at a spaced interval. The connector 32 is mounted on the top surface of the door panel 41.

With reference to FIGS. 9 and 10, when the automatic sliding door in accordance with the present invention is in use, the door panel 41 is pulled or pushed, and this makes the pulley set 30 slide in the rail 10.

With reference to FIGS. 7 to 10, when a user pulls the door panel 41 and the door panel 41 slides away from the reset component 20, the first elastic component 23 of the reset component 20 would be pulled out from the housing 21. The door panel 41 is pulled by the first elastic component 23 and slides toward the reset component 20 when the door panel 41 is released by the user. Furthermore, the guide wheel 29 may be level with the first elastic component 23, and this makes the door-pulling process smoother.

In addition, the second elastic component 25 of the reset component 20 may adjust the pulling strength of the first elastic component 23.

With reference to FIGS. 3, 4, and 7, when the switch 28 is rotated, the switch 28 would drive the fixed pillar 24 to rotate. Because the fixed pillar 24 is fixed to the second elastic component 25, the rotation of the fixed pillar 24 would drive the second elastic component 25 to roll. In addition, the second elastic component 25 is wound while being rotated, and the second end of the second elastic member 25 is rotated by the force of the second elastic component 25. In other words, when the user pulls the door panel 41, the first elastic component 23 and the rod 22 rotate. The second elastic component 25 is not expanded as the first elastic component 23. In other words, the user rotates the rod 22 by the first elastic component 23 because the pulling direction is opposite to the direction in which the second elastic component 25 pulls the rod 22.

With reference to FIG. 5, in order to make the second elastic component 25 fixed after being pressed by the pulling force, the second elastic component 25 cannot be restored to the original state. When the user turns the switch 28, this will force to rotate the fixing pillar 24 with the switch 28. The fixed clasp 27 and the fixing pillar 24 will be disengaged from the mounting holes 213 and are rotated to engage with another mounting hole 213, so that the second elastic component 25 cannot be reset to the original unforced state.

Through the reset component 20 that can be automatically reset, the door panel 41 can be automatically restored to the closed state after being opened, and the structure of the present invention is simple. Installing the sliding rail 10 and the reset component 20 is easy. As a result, the present invention can overcome and improve the disadvantages of the prior art through the aforementioned features.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An automatic sliding door comprising:

a rail having a first end;

a second end;

a reset component mounted on the first end of the rail and having a housing having a first side surface; and a second side surface;

a rod rotatably mounted in the housing;

a first elastic component mounted in the housing, mounted around the rod, and having a first end fixed to the rod; and a second end extending out of the housing;

a pulley set slidably mounted in the rail, a bottom end of the pulley set extending out of the rail, and the pulley set having a first end connected with the second end of the first elastic component; and a second end, wherein the first elastic component continually pulls the pulley set toward the reset component; and a door panel mounted on the pulley set;

wherein the reset component has a fixed pillar a second elastic component mounted in the housing, mounted between the rod and the fixed pillar, and having a first end fixed to the fixed pillar; and a second end mounted on the rod.

2. The automatic sliding door as claimed in claim 1, wherein the fixed pillar is rotatably mounted through the housing and mounted through the rod.

3. The automatic sliding door as claimed in claim 1, wherein the housing has multiple mounting holes formed through the first side surface; and the reset component has a fixed clasp mounted on the first side surface of the housing and fixed to the fixed pillar.

4. The automatic sliding door as claimed in claim 3, wherein the reset component has a guide wheel rotatably mounted in the housing, and the guide wheel abuts the second end of the first elastic component.

5. The automatic sliding door as claimed in claim 3, wherein the pulley set has a connector; and at least one pulley mounted on the connector.

6. The automatic sliding door as claimed in claim 3, wherein the first elastic component is a torsion spring.

7. The automatic sliding door as claimed in claim 1, wherein the second elastic component is a torsion spring.

8. The automatic sliding door as claimed in claim 7, wherein the reset component has a guide wheel rotatably mounted in the housing, and the guide wheel abuts the second end of the first elastic component.

9. The automatic sliding door as claimed in claim 7, wherein the pulley set has a connector; and at least one pulley mounted on the connector.

10. The automatic sliding door as claimed in claim 7, wherein the first elastic component is a torsion spring.

11. The automatic sliding door as claimed in claim 1, wherein the reset component has a switch mounted on the second surface of the housing and connected with the fixed pillar.

12. The automatic sliding door as claimed in claim 11, wherein the reset component has a guide wheel rotatably mounted in the housing, and the guide wheel abuts the second end of the first elastic component.

13. The automatic sliding door as claimed in claim 11, wherein the pulley set has a connector; and at least one pulley mounted on the connector.

14. The automatic sliding door as claimed in claim 2, wherein the reset component has a guide wheel rotatably mounted in the housing, and the guide wheel abuts the second end of the first elastic component.

15. The automatic sliding door as claimed in claim 2, wherein the pulley set has a connector; and at least one pulley mounted on the connector.

16. The automatic sliding door as claimed in claim 2, wherein the first elastic component is a torsion spring.

17. The automatic sliding door as claimed in claim 1, wherein the reset component has a guide wheel rotatably mounted in the housing, and the guide wheel abuts the second end of the first elastic component.

18. The automatic sliding door as claimed in claim 1, wherein the pulley set has a connector; and at least one pulley mounted on the connector.

19. The automatic sliding door as claimed in claim 18, wherein the pulley set includes two pulleys; and the connector has a cushion, the cushion is mounted in the connector, and the cushion has two ends respectively connected with the two pulleys.

20. The automatic sliding door as claimed in claim 1, wherein the first elastic component is a torsion spring.

* * * * *